United States Patent [19]

Gondo et al.

[11] 4,145,235

[45] Mar. 20, 1979

[54] PROCESS FOR PRODUCING COLD ROLLED STEEL SHEET AND STRIP HAVING IMPROVED COLD FORMABILITIES

[75] Inventors: Hisashi Gondo; Hiroshi Takechi; Mitsunobu Abe; Kazuo Namba, all of Kisarazu, Japan

[73] Assignee: Nippon Steel Corporation, Tokyo, Japan

[21] Appl. No.: 837,705

[22] Filed: Sep. 29, 1977

Related U.S. Application Data

[63] Continuation-in-part of Ser. No. 648,668, Jan. 13, 1976, abandoned, which is a continuation-in-part of Ser. No. 600,429, Jul. 30, 1975, abandoned, which is a continuation of Ser. No. 429,200, Dec. 28, 1973, abandoned.

[30] Foreign Application Priority Data

Dec. 28, 1972 [JP] Japan ..... 47-130220

[51] Int. Cl.[2] ..... C21D 9/48

[52] U.S. Cl. ..... 148/12 C; 148/142

[58] Field of Search ..... 148/12 C, 12 F, 12.3, 148/2, 3, 134, 142, 36

[56] References Cited

U.S. PATENT DOCUMENTS

| | | | |
|---|---|---|---|
| 3,492,173 | 1/1970 | Goodenow | 148/12 |
| 3,806,376 | 4/1974 | Toda et al. | 148/12.3 |
| 3,839,095 | 10/1974 | Kubotera et al. | 148/12 C |
| 3,988,173 | 10/1976 | Kawano | 148/12 C |

*Primary Examiner*—W. Stallard

*Attorney, Agent, or Firm*—Toren, McGeady and Stanger

[57] ABSTRACT

A process of producing a cold rolled killed steel sheet with good cold formabilities particularly by continuous-annealing, and more particularly to a process of producing cold rolled steel sheet and strip having particularly enhanced deep drawability by controlling the chemical composition and compositional proportions of the killed steel as well as the high temperature coiling after a hot rolling operation.

7 Claims, 5 Drawing Figures

PROCESS FOR PRODUCING COLD ROLLED STEEL SHEET AND STRIP HAVING IMPROVED COLD FORMABILITIES

CROSS REFERENCE TO RELATED APPLICATIONS

This application is a continuation-in-part of our copending application, Ser. No. 648,668, filed on Jan. 13, 1976, which, in turn, was a continuation-in-part of application Ser. No. 600,429, filed July 30, 1975, which, in turn, was a continuation of application Ser. No. 429,200, filed Dec. 28, 1973, the contents of each of said prior applications being incorporated herein by reference, and each of which applications are now abandoned.

DETAILED EXPLANATION OF THE INVENTION

This invention relates to a process of producing a cold rolled Al-killed steel sheet with good cold formabilities particularly by continuous-annealing, and more particularly to a process of producing cold rolled steel sheet and strip having particularly enhanced deep drawability by controlling the chemical composition and compositional proportions of the Al-killed steel as well as the high temperature coiling after a hot rolling operation, and a specific continuous annealing.

Aluminum-killed steels have been generally used for deep drawing applications. For applications requiring considerable degree of press forming such as automotive trim, sheets and strips produced from the aluminum killed steels by a process including hot and cold rolling and a box annealing treatment are employed. Although these sheets and strips have non-aging property due to the fixation of N by Al as AlN, one drawback to the use of the sheets and strips in forming applications is their poor deep drawing property, as represented by a low $\bar{r}$ value between 1.4 and 1.7, so that in applications involving severe press forming such as automotive fenders, cracks often occur during the forming operations when the $\bar{r}$ value is low. Therefore, a method of consistent production of a steel sheet and strip having increased deep drawability, or $\bar{r}$ value has so far been seeked for. Another disadvantage of the conventional process for producing steel sheets and strip having $\bar{r}$ values between 1.4 and 1.7 from the aluminum killed steels is a very inefficient practice of the box annealing treatment with respect to the extremely long annealing time, the period of time from the beginning of heating to the termination of annealing reaching a week. But it has been compelled to employ the box annealing treatment for the achievement of acceptable $\bar{r}$ value from 1.4 to 1.7 on the basis of AlN precipitation during the annealing.

In the conventional continuous annealing enough $\bar{r}$ values can not be obtained due to the short-time annealing, and the steel strip is rapidly cooled after the annealing, so that the carbon in the steel is retained in solid solution and does not completely precipitate even by the subsequent over-aging treatment, thus showing a peculiar aging deterioration called "carbon aging" in the final product.

Over long years, the present inventors have conducted investigations, and have found a solution of the above mentioned problems, that is, a method of increasing $\bar{r}$ values to sufficient high level with elimination of the inefficient practice of the box annealing treatment from the process as well as prevention of the carbon aging. From the industrial standpoint, the solution is very significant.

It is a main object of the present invention to provide a process of producing annealed and particularly continuous annealed, cold rolled killed steel sheet and strip with very excellent deep drawability as well as very excellent non-aging quality by controlling the chemical composition of the aluminum-killed steel as well as the conditions of the hot-rolling treatment and the conditions of continuous annealing.

It is another object of the present invention to provide a killed steel with a plastic-strain ratio, $\bar{r}$ of not less than 1.6 by continuous annealing.

These and other objects of the invention will become more apparent from the following description in reference with the accompanying drawings in which.

Figure 1:
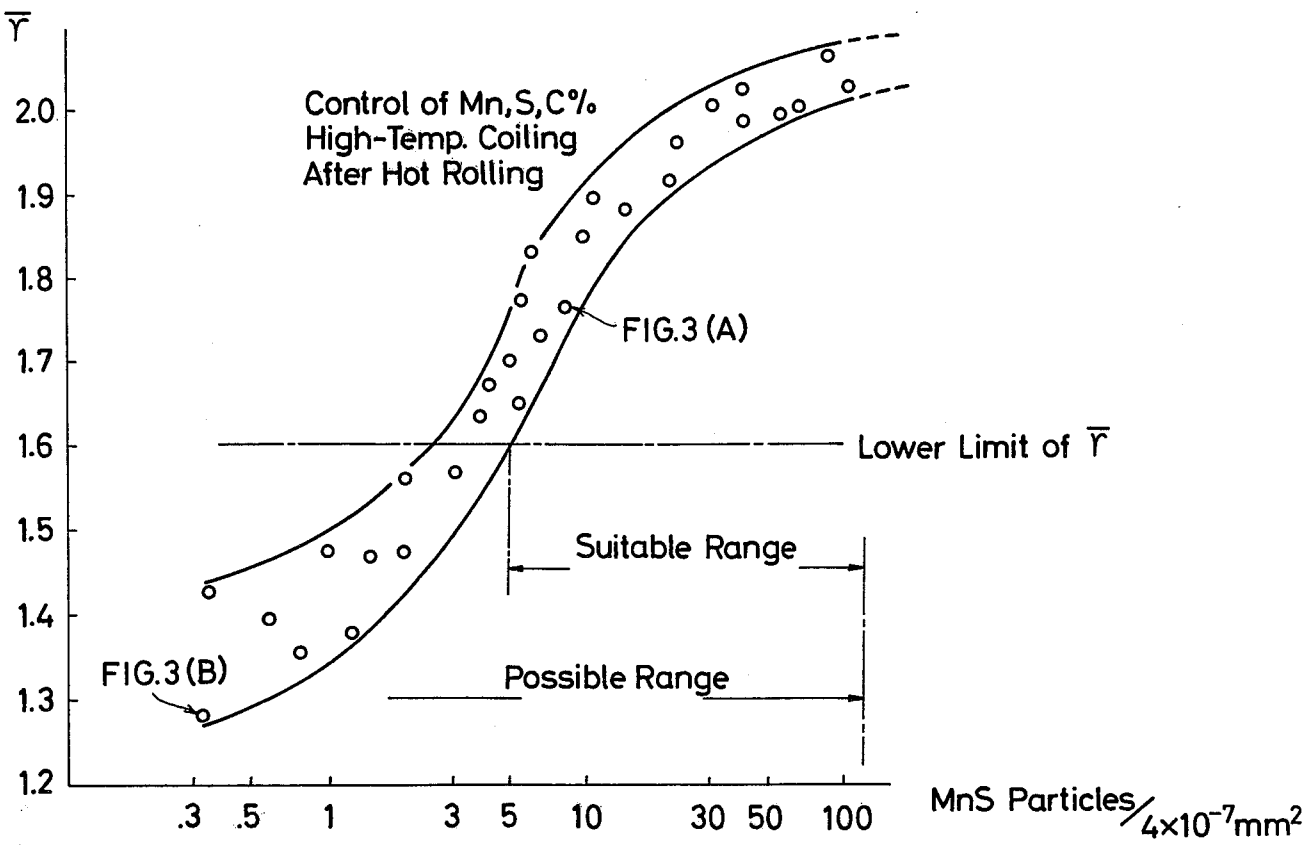
FIG. 1 is a graph showing the relationship between the $\bar{r}$ values and the number of fine MnS not larger than 300Å per $4 \times 10^{-7}mm^2$ distributed in steel sheet prior to the cold rolling.

The first feature of the invention is concerned with the chemical composition. The present inventors have discovered that particular properties of the continuous annealed sheet and strip are largely affected by the contents of carbon, manganese and sulfur in the aluminum-killed steel.

The required properties of a press-forming cold rolled killed steel sheet depend mainly on the $\bar{r}$ value and the aging property. The term "$\bar{r}$ value" is otherwise called "plastic-strain ratio." The plastic-strain ratio is defined as the ratio of the width-strain to the thickness-strain determined during the tension testing of sheet specimens. It is a measure of the mechanical properties, and it is well known to be a very good measure of the deep drawability of metal, and the average plastic-strain ratio, $\bar{r}$ is widely used. As the $\bar{r}$ value increases, the deep drawability increases. Usual rimmed steels have $\bar{r}$ values of about 1.3, and box-annealed aluminum-killed steels have $\bar{r}$ values of about 1.6.

Explanations will be made regarding the ranges for C, Mn and S contents required for obtaining similar or better properties of press-forming aluminum-killed cold rolled steel sheets produced by continuous annealing as compared by those obtained by the conventional box annealing.

According to the present invention the C content is defined from 0.02 to 0.08%, the Mn content is defined to not more than 0.25%, the Mn/S ratio is defined from 7 to 30 and the Al content is defined to not more than 0.07%.

With a carbon content less than 0.02%, the carbon precipitation during the over-aging treatment is delayed so that a large amount of solid solution carbon remains and the aging deterioration can not be prevented. Namely, the reason for limiting the carbon content to not less than 0.02% is as below.

As mentioned hereinbefore, the $\bar{r}$ value and the carbon aging property may be listed as important factors which represents the properties of a press-forming cold rolled steel sheet produced by continuous annealing. In particular, the present invention is based on the new discovery that the carbon aging property is remarkably improved when the carbon content increases and thus the number of carbides increases so that precipitation sites increase during the over-aging.

On the other hand, when the carbon content exceeds 0.08%, the steel hardens excessively and thus unsuitable for press forming.

Also a manganese content beyond 0.25% hardens the steel. Manganese should be added in an amount enough to prevent hot embrittlement due to S, and thus the Mn/S ratio is defined from 7 to 30. However, an excessive amount of manganese hardens the steel and thus it should be not more than 0.25%.

Further, as for the conditions of the steel composition, the present inventors have found new conditions which overthrow the generally accepted concept of aluminum in a conventional aluminum-killed steel.

In the conventional box annealing, as the heating rate is remarkably slow, it is possible to improve the $\bar{r}$ value by utilizing the concurrence between the AlN precipitation and recovery recrystallization during the heating. On the other hand, in the continuous annealing, as the heating rate is remarkably high, there is limitation in improving the $\bar{r}$ value utilizing AlN.

The present invention has taken into consideration these findings and provides a method which can improve the $\bar{r}$ value by means other than AlN, and thus is completely different from the conventional art for improving the $\bar{r}$ value of aluminum-killed steels.

According to the present invention, the pattern of MnS particles which are present in the steel sheet prior to the cold rolling is controlled, and the Mn%/S% ratio is maintained between 7 and 30 so as to avoid that Mn and S in their elemental form remain in an extremely excessive amount after the formation of MnS, and Mn is maintained not more than 0.25%, preferably not more than 0.20% while S is maintained not more than 0.03%, preferably not more than 0.02% in order to adjust the amount of MnS itself.

When Mn and S are present in an excessively small amount, the pressure of fine MnS particles is not appropriate and thus it is necessary that Mn is present in an amount of not less than 0.05% and S is present in an amount of not less than 0.002%.

With the adjustment of the steel composition as stated above, the basis for remarkable improvement of the $\bar{r}$ value is provided.

According to the present invention, the distribution of MnS in the steel sheet after the hot coiling, namely prior to the cold rolling should be such that its fine particles are distributed in a large amount in order to obtain excellent cold forming property. Thus, as shown in FIG. 1, in order to assure a $\bar{r}$ value of not lower than 1.6, it is necessary that fine MnS particles not larger than 300Å exist not less than 5 per $4 \times 10^{-7}mm^2$ in the steel sheet prior to the cold rolling.

It is necessary that the heat retained after the hot coiling is effectively utilized to accomplish formation of MnS, and that the coiling is done at a high temperature not lower than 735° C. to control the distribution of MnS particles so as to assure not less than 5 fine MnS particles of not larger than 300Å per $4 \times 10^{-7}mm^2$.

The above is the basic condition of the present invention for obtaining by continuous annealing an aluminum-killed cold rolled steel sheet having a better $\bar{r}$ value as compared with that of the conventional box-annealed steel materials.

Thus, according to the present invention, Al is added only for the two purposes; first purpose of fixing oxygen as oxide to lower the required content of Mn by saving Mn which is wastefully consumed by formation of MnO; and second purpose of fixing N as nitride to make the steel non-aging, and not more than 0.07% Al is sufficient for the purposes.

As Al combines with O as N to form $Al_2O_3$ and AlN, the lower limit of the Al content is defined by the following formula depending on O (normally less than about 100 ppm) and N (normally less than about 100 ppm) which are present as impurities $$Al\,(\%) \geqq \frac{54}{48}\,O(\%) + 2N(\%)$$

When Al is added beyond 0.07%, AlN is dispersed very finely to hinder the grain growth during the continuous annealing thus lowering the $\bar{r}$ value.

Further according to the present invention, at least one of B and Ti may be added to fix firmly as nitride for improvement of the non-aging property. In this case, however, when the formed BN and TiN are dispersed finely the $\bar{r}$ value is lowered just as in case of AlN, B should be not larger than 0.05% and Ti should be not larger than 0.08%.

Addition of Al, B and Ti may be effected in any step before a steel ingot in case of an ordinary ingot making process or a steel slab in case of a continuous casting process solidify. However it is preferable Al as deoxidizer is added first to fix O and then B and Ti are added.

As for the secondary basic condition of the present invention, the coiling temperature in the hot rolling is the important parameter.

Figure 2:
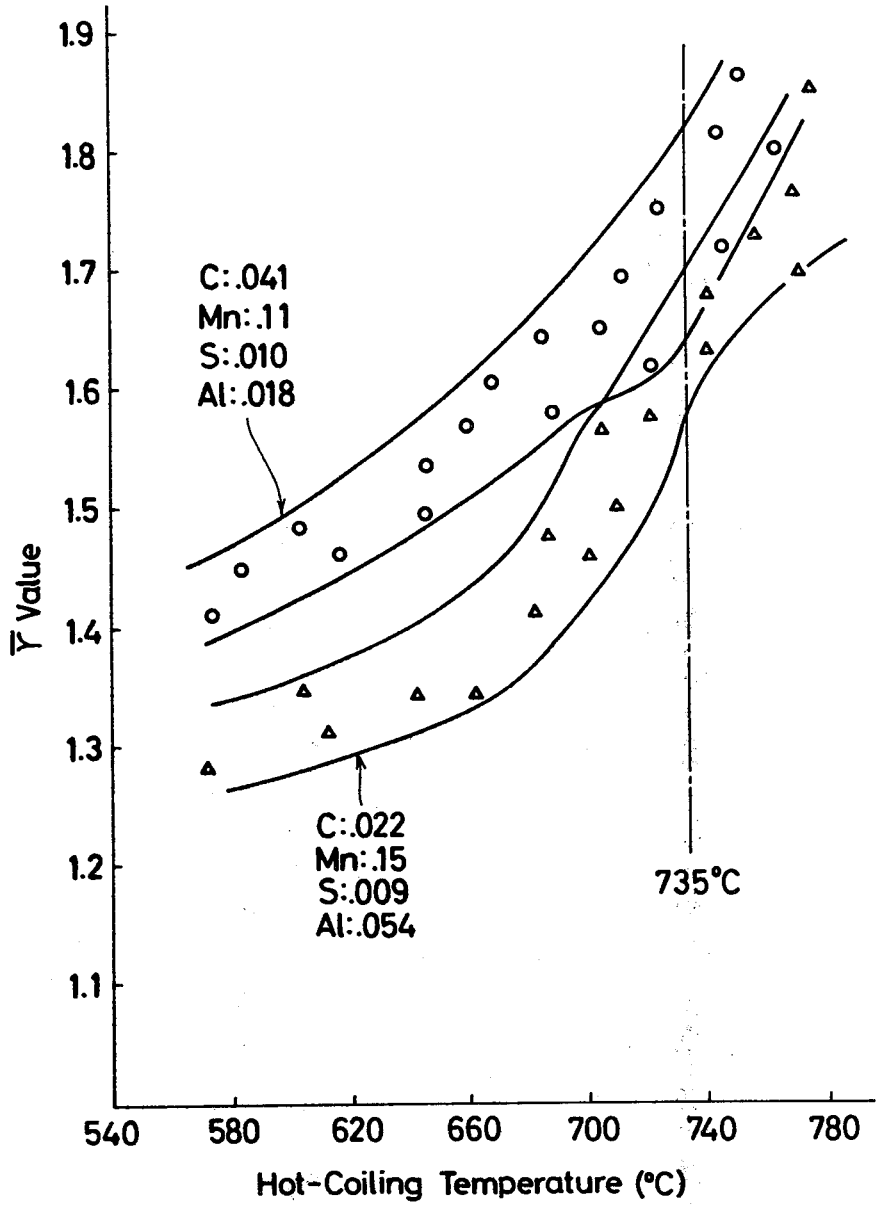
FIG. 2 is a graph showing the effect of coiling temperature on $\bar{r}$ value.

FIG. 2 shows the relationship between the coiling temperature and the $\bar{r}$ value of the steel products having respectively a composition: C: 0.022%, Mn: 0.15%; S: 0.009%, Al: 0.054% (marked by Δ in FIG. 2) and a composition: C: 0.041%, Mn: 0.11%, S: 0.010%, Al: 0.018% (marked by ○ in FIG. 2).

As clearly understood from FIG. 2, when the steel is coiled at a high temperature not lower than about 735° C., the $\bar{r}$ value is remarkably improved. This improvement can be attributed to the distribution of fine MnS as defined hereinbefore, namely not less than 5 fine MnS particles of not larger than 300Å per $4 \times 10^{-7}mm^2$ prior to the cold rolling.

As for the number of the fine MnS particles, as the number increases the $\bar{r}$ value is improved more as clearly shown in FIG. 1. However, from the aspect of commercial practice a distribution up to about 110 particles per $4 \times 10^{-7}mm^2$ at best is attainable, and from the aspect of the $\bar{r}$ value improvement also, the improvement becomes saturated toward this distribution limit.

Figure 3A:
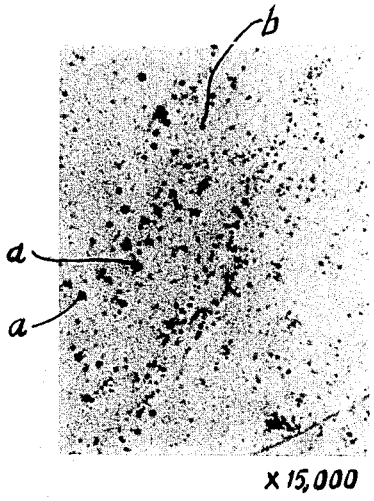
FIG. 3 is an electron microscope photography (× 15,000) of a steel sheet prior to the cold rolling.
Figure 3B:
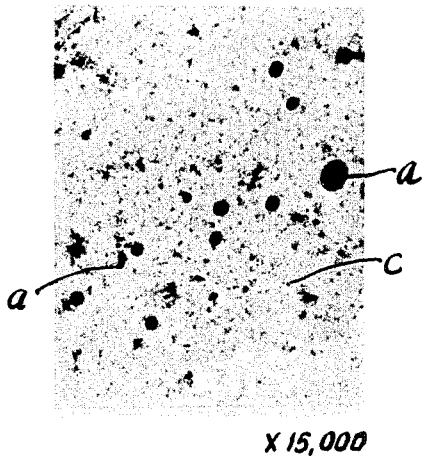

FIGS. 3(A) and 3(B) are respectively an electron microscope photograph (× 15,000) of the MnS particle distribution with not less than 5 particles of not larger than 300Å per $4 \times 10^{-7}mm^2$, and the MnS particle distribution with less than 5 particles of not larger than 300Å per $4 \times 10^{-7}mm^2$. When observed by these electron microscope photographs (× 15,000), the particle of 300Å can be observed as 0.45mm size. Thus points (b) among the black points in FIGS. 3(A) and 3(B) represent the MnS particle of about 300Å, and smaller black points (c) represent the MnS particle of not larger than 300Å which is aimed at by the present invention, the larger points (a) represent the MnS particle of larger than 300Å which is outside the scope of the present invention. The number of the MnS particles of not larger than 300Å may be measured by the following procedures.

(i) an electron microscope photograph ( × 15,000) is taken (see FIG. 3(A))
(ii) cross lines of 10mm square are drawn
(iii) the virtual dimension of the 10mm square is 9.5 × 9.5 = 90.25mm$^2$ (the width of the lines is 0.5mm) Thus, 90.25/(15,000)$^2$ = 4 × 10$^{-7}$mm$^2$, and
(iv) for each of 35 squares, the number of the MnS particles of not larger than 0.45mm (black points (b) and (c) in FIGS. 3(A) and 3(B)) is counted to produce an average number per 4 × 10$^{-7}$mm$^2$.

The observable lower limit of the MnS particle size depends on the resolving power of an electron microscope to be used, and the resolving power of an ordinary electron microscope is about 20Å or larger. Thus fine MnS particles as 20Å can be observed.

The steels of FIGS. 3(a) and 3(b) had the composition shown in the following Table 1-A and were prepared by smelting in a converter, continuously casting to obtain steel slabs and hot rolling by conventional methods to produce hot rolled steel sheets with a thickness of 3.2 mm. The coiling temperature at this stage was 740° C. The hot rolled sheets were then acid pickled and cold rolled to produce a cold rolled sheet having a thickness of 0.8 mm.

The cold rolled sheets were subject to continuous annealing under the following conditions:

Table 1 - A

| | Chemical Composition (wt.%) | | | | | | | | |
|---|---|---|---|---|---|---|---|---|---|
| Sample | C | Si | Mn | P | S | N*1 | O*1 | Al | K*2 |
| FIG. 3a | 0.043 | 0.02 | 0.11 | 0.010 | 0.008 | 47 | 53 | 0.036 | 0.10 |
| FIG. 3b | 0.045 | 0.01 | 0.27 | 0.013 | 0.015 | 40 | 60 | 0.039 | 0.24 |

Remarks: Analysis of hot rolled sheet
*1: ppm
*2: $K = [Mn(\%)] - \frac{55}{32}[S(\%)]$

| | |
|---|---|
| Soaking temperature: | 850° C |
| Soaking time: | 40 sec. |
| Cooling rate to the over-aging zone: | 8° C/sec. (in average) |
| Over-aging temperture: | 400° C |
| Cooling after over-aging: | forced cooling with inert gas jet to 400° C |
| Skin pass: | 0.8%. |

Referring back to the coiling temperature in the hot rolling step, a higher temperature will produce finer MnS particles in a greater number in the steel sheet, thus improving the $\bar{r}$ value still further. However, the upper limit of the coiling temperature may be set at 860° C., because beyond this temperature, the oxide film formed on the surface of the hot rolled steel strip becomes thicker and causes difficulties in acid pickling prior to the cold rolling.

The desired objects of the present invention can be obtained by combination of the specific steel composition and the specific coiling conditions as defined above. In addition, the slab heating temperature prior to the hot rolling may be maintained between 1100° and 1300° C., and the hot rolling finishing temperature may be an ordinary finishing temperature in the art, but must be not lower than the $A_3$ point. For improving the surface cleanness of the final product, it is desirable that the cooling from the finishing temperature of the hot rolling to the coiling temperature is done slowly around the $A_3$ point.

Further, it is preferable that the cold rolling is done with a reduction between 60 and 90%.

Figure 4:
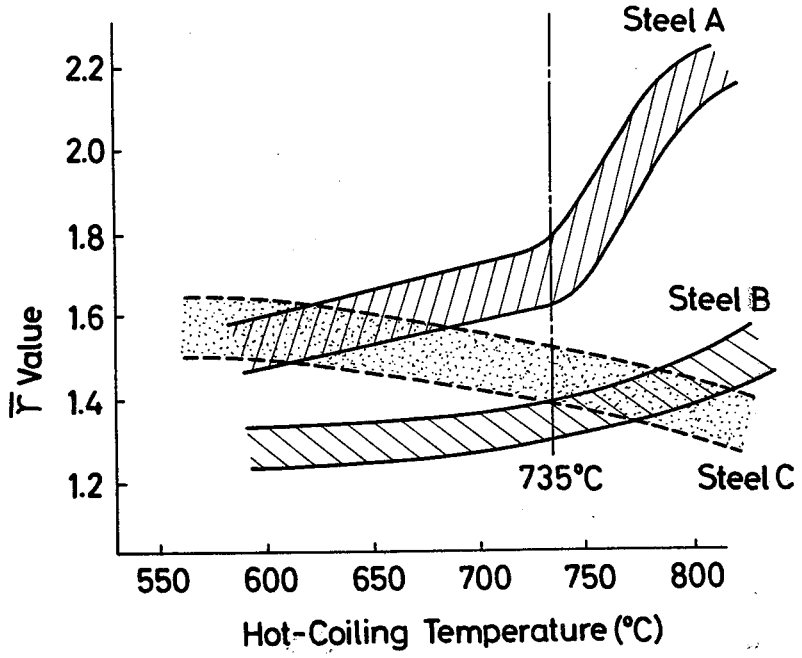
FIG. 4 is a graph showing the hot-coiling temperature dependence of $\bar{r}$ value in the steel sheet of the invention as compared with the prior art aluminum-killed steel sheet.

FIG. 4 shows the $\bar{r}$ value obtained when the three steel compositions shown in Table 1 were hot rolled and coiled at various coiling temperatures. The steel A has a composition within the scope of the present invention and is continuously annealed under the specific conditions as defined in the present invention, the steel B is a conventional aluminum-killed steel having a composition outside the scope of the present invention and is continuously annealed according to the present invention, and the steel C has a composition within the scope of the present invention and is box-annealed.

Table 1-B

| Steel | C | Mn | S | O | Al | N | Remarks |
|---|---|---|---|---|---|---|---|
| A | 0.04–0.06 | 0.14–0.19 | 0.00° – 0.015 | 0.005–0.008 | 0.015–0.030 | 0.0017–0.0029 | Inventive steel |
| B | 0.04–0.06 | 0.28–0.32 | 0.011–0.016 | 0.004–0.009 | 0.020–0.041 | 0.0018–0.0030 | Comparative steel |
| C | 0.04–0.06 | 0.14–0.20 | 0.009–0.015 | 0.006–0.007 | 0.016–0.035 | 0.0015–0.0029 | Batch annealing |

As understood from FIG. 4 in case of the conventional aluminum-killed steel B in which precipitation of AlN is utilized, only a $\bar{r}$ value of 1.4 to 1.5 can be obtained even when the continuous annealing according to the present invention is given or even when the coiling is done at a higher temperature in the temperature range.

And in case of the steel C, which is box-annealed to precipitate AlN, the $\bar{r}$ value is low due to the slow heating inherent to the batch-type annealing in spite of the steel composition within the scope of the present invention, and the $\bar{r}$ value is rather lowered by the high temperature coiling. Whereas in case of the steel A of the present invention, a higher level of the $\bar{r}$ value can be obtained with a higher coiling temperature, and a $\bar{r}$ value as high as 2.0 or higher can be obtained. This result is attributed to full precipitation of fine MnS particles during the high temperature coiling rather than to the AlN precipitation. The effects of the high temperature coiling are very remarkable when the temperature is not lower than 735° C.

Next as the third feature of the present invention, the temperature conditions in the continuous annealing may be mentioned.

For obtaining the maximum $\bar{r}$ value together with a general material quality favourable to press forming stably and consistently on a commercial scale, it is necessary that recrystallization annealing is done within a temperature range from about 680° to 880° C., preferably from 750° to 850° C., and cooling is done from the recrystallization temperature to a temperature between over-aging temperature and 200° C. with a cooling rate of about 5° to 30° C./second, preferably 5° to 20° C./second, and the over-aging is done within a temperature range from about 350° to about 600° C., preferably from 400° to 500° C.

In the present invention, the reason for defining the lower limit of the recrystallization temperature to 680° C., preferably 750° C. is to obtain sufficiently high $\bar{r}$ values. And the reason for defining the upper limit of annealing temperature of 880° C., preferably 850° C. is to prevent the decrease in the $\bar{r}$ value caused by the $A_3$ transformation.

As for the treating time of the recrystallization annealing, 40 seconds to 5 minutes are appropriate.

Also, the cooling from the recrystallization temperature has been defined as above, because when the cooling is done at a rate above 30° C./second, the carbides which precipitate during the over-aging become excessively fine so that the elongation lowers remarkably after the aging and desired cold forming property can not be obtained, and on the other hand when the cooling rate is lower than 5° C./second, the production efficiency inherent to the continuous annealing can not be maintained. Although there is no substantial difference in the results when the cooling from the recrystallization temperature is done to a temperature between the over-aging temperature and 200° C., however, the precipitating carbides become excessively fine and cause similar difficulty as caused by the rapid cooling when the cooling is done to a temperature below 200° C. Thus the lower limit of the cooling temperature has been set at 200° C. in the present invention.

In the present invention which is directed to steels having lowered manganese contents, the over-aging temperature must be as defined above and the over-aging time should be not longer than 10 minutes, desirably not longer than 8 minutes.

As for the recrystallization annealing temperature, a higher temperature up to the $A_3$ transformation point produces a better r value, but the upper limit is defined as above.

The desired results of the present invention can be obtained when the recrystallization and the over-aging are done with a continuously lowering temperature or with a stepwisely lowering temperature, so far as the temperature is within the above defined ranges.

Further in case when a continuously annealed steel strip according to the present invention is subsequently temper rolled on line, it is desirable the cooling from the over-aging temperature is done to 50° C. or lower and the temper rolling is done at the temperature so as to obtain an excellent shape of the cold rolled steel sheet.

The present invention will be more clearly understood from the following examples, but it should be noted that the present invention is not limited thereto.

EXAMPLE 1

Molten steel of C: 0.04%, Mn: 0.14%, S: 0.010% prepared in a converter was poured into an ingot mold of bottom-pour type and Al was added to obtain a rim-stabilized steel containing 0.023% Al. This steel ingot was made into a slab which was hot rolled with a finishing temperature of 890° C. and a coiling temperature of 750° C.

Samples were taken from the hot rolled steel sheet, ground and polished, and observed by an electron microscope of 15,000 times magnification. The results revealed that 22 fine MnS particles not larger than 300Å distributed per $4 \times 10^{-7}mm^2$. This hot rolled steel sheet was further cold rolled with 72% reduction into 0.8mm thickness.

The cold rolled steel sheet thus obtained was subjected to recrystallization annealing at 850° C. for one minute in a continuous annealing apparatus, subsequently cooled to 450° C. at a cooling rate of 8° C./second, then subjected to over-aging at 450° C. for 1.5 minutes, cooled to room temperature, and temper rolled with 1.0% reduction. The properties of the product thus obtained as shown in Table 2.

Table 2

| | Yield point ($kg/mm^2$) | Totel elongation (%) | Yield point elongation(%) | $\bar{r}$ |
|---|---|---|---|---|
| After temper rolling | 18.9 | 45.2 | 0 | 2.09 |
| After aging at 100° C for one hour | 19.7 | 44.6 | 0.2 | |

EXAMPLE 2

Aluminum-killed molten steel having a composition of C: 0.06%, Mn: 0.17%, S: 0.009%, Al: 0.028% was prepared in a converter, and one of B and Ti was added during continuous casting to obtain the steel compositions shown in Table 3.

Table 3

| Steel | C | Mn | S | Al | B | Ti | N | O |
|---|---|---|---|---|---|---|---|---|
| 1 | 0.06 | 0.17 | 0.009 | 0.028 | — | — | 0.0028 | 0.005 |
| 2 | 0.06 | 0.18 | 0.010 | 0.027 | 0.023 | — | 0.0029 | 0.007 |
| 3 | 0.06 | 0.17 | 0.009 | 0.026 | — | 0.041 | 0.0028 | 0.006 |
| 4 | 0.06 | 0.35 | 0.009 | 0.031 | — | — | 0.0032 | 0.008 |

The comparative steel No. 4 was prepared separately, these steels were soaked at 1200° C., hot rolled with a finishing temperature of 895° C., cooled at 765° C., then acid-pickled and cold rolled with 82% reduction into 0.8mm thickness. Subsequently, these cold rolled steel sheets were heated to 850° C. and subjected to continuous recrystallization annealing for one minute while the temperature lowered gradually from 850° to 800° C., cooled to 300° C. from 800° C. with a cooling rate of 12° C./second, subsequently subjected to over-aging for two minutes while the temperature lowered gradually from 550° to 350° C., further cooled to 35° C., and temper rolled with 1% reduction. Mechanical properties tested just after the temper rolling and after strain-aging at 40° C. for one month are shown in Table 4.

Table 4

| Steel No. | | Yield point ($kg/mm^2$) | Total Elongation (%) | Yield point Elongation(%) | $\bar{r}$ |
|---|---|---|---|---|---|
| 1 | After temper rolling | 19.3 | 44.8 | 0 | 1.98 |
| | After aging | 20.0 | 44.1 | 0.1 | |
| 2 | After temper rolling | 18.8 | 45.2 | 0 | 1.97 |
| | After aging | 18.9 | 45.2 | 0 | |
| 3 | After temper rolling | 19.4 | 45.0 | 0 | 1.99 |
| | After aging | 19.5 | 45.0 | 0 | |
| 4 | After temper rolling | 21.2 | 43.5 | 0 | 1.47 |
| | After aging | 23.5 | 42.1 | 1.2 | |

The steels No. 1, No. 2 and No. 3 show larger $\bar{r}$ values and elongation values, lower yield point values and better cold workability as compared with the comparison steel No. 4.

Also it is clear from the results, that the increase of the yield point and the yield point elongation and the lowering of the total elongation due to the strain aging are smaller in the present invention, and this indicates that the steel sheet of the present invention is non-aging. The steel No. 1 which does not contain B and Ti shows satisfactory non-aging property, and the steels No. 2 and No. 3 which contain B and Ti are completely non-aging.

EXAMPLE 3

Aluminum-killed molten steel having a composition of C: 0.04%, Mn: 0.13%, S: 0.009%, Al-0.032%, O: 0.008%, N: 0.0036% thus satisfying the condition $$Mn(\%)/S(\%) \approx 14.4, \text{ and}$$

$$Al(\%) - (54/48).O(\%) \approx 6.4.N(\%)$$

was prepared in a converter and made into slabs. The slabs were hot rolled with a finishing temperature of 930° C. into 2.4mm thickness, coiled at various temperatures shown in Table 5, cold rolled into 0.8mm thickness, subjected to recrystallization annealing at 850° C. for two minutes, cooled from the temperature to 370° C. with a cooling rate of 17° C./second, subjected to over-aging at 370° C. for three minutes, subsequently cooled to ordinary temperature, temper rolled with 1% reduction and aged at 100° C. for one hour. Various properties of the products thus obtained were measured, and the following facts were revealed. In case of the comparative steels No. 1 to No. 5 also, the $\bar{r}$ value tends to increase as the coiling temperature increases, but the tendency is not remarkable. In case of the steels No. 6 to No. 9 which are within the scope of the present invention, the $\bar{r}$ value sharply increases, and no yield point elongation after the aging is observed.

Particularly in the steels No. 8 and No. 9, the conical cup value (CCV) showed "drawing out," thus indicating that the deep drawability was improved to an extreme degree impossible to measure quantatively by this test method.

Table 5

Coiling Temperatures and Properties

| No. | Coiling Temperature(° C) | Number of MnS not larger than 300Å per $4\times10^{-7}$ mm$^2$ | After Temper Rolling: Yield Stress (kg/mm$^2$) | Tensile Strength (kg/mm$^2$) | Elongation (%) | $\bar{r}$ Value | CCV (mm) | Yield Point Elongation after Aging (%) | Remarks |
|---|---|---|---|---|---|---|---|---|---|
| 1 | 520 | 1.8 | 23.0 | 35.1 | 40 | 1.23 | 38.1 | 1.3 | Comparative |
| 2 | 560 | 2.1 | 23.1 | 34.8 | 40 | 1.36 | 38.0 | 1.1 | |
| 3 | 600 | 2.9 | 21.6 | 34.9 | 42 | 1.48 | 37.5 | 0.5 | |
| 4 | 650 | 3.3 | 19.8 | 34.2 | 43 | 1.49 | 37.3 | 0.4 | |
| 5 | 700 | 4 | 19.3 | 33.8 | 44 | 1.55 | 36.8 | 0 | Inventive |
| 6 | 740 | 7 | 17.5 | 33.6 | 45 | 1.63 | 36.1 | 0 | |
| 7 | 750 | 19 | 16.2 | 33.1 | 45 | 1.71 | 36.0 | 0 | |
| 8 | 765 | 32 | 15.6 | 32.9 | 46 | 1.99 | drawing out | 0 | |
| 9 | 790 | 58 | 15.3 | 32.8 | 46 | 2.11 | " | 0 | |

What is claimed is:

1. A method for producing a cold rolled steel sheet having excellent cold-formability comprising;

hot rolling an aluminum killed steel slab, coiling the hot rolled band at a temperature not lower than 735° C. to produce a manganese sulfide particle distribution of at least 5 particles per $4\times10^{-7}$mm$^2$, the manganese sulfide particles having a diameter not larger than 300Å, cold rolling the hot rolled band into a strip, heating the cold rolled strip to a temperature from about 750° C. to 850° C. to effect recrystallization annealing, and then cooling the strip from said annealing temperature at an average cooling rate from at least about 5°-30° C./sec. to a temperature between over-aging temperature and not less than 200° C., and then over-aging the strip at a temperature ranging from about 350° C. to 650° C., said steel slab comprising;

C: about 0.02–0.08%

Mn: about not more than 0.25% with a Mn/S = about 7 to 30

Al: not more than about 0.07 with the balance being iron and unavoidable impurities.

2. A method according to claim 1, in which the slab further comprises at least one of not more than 0.05% B and not more than 0.08% Ti.

3. A method according to claim 1, in which the slab contains 0.002 to 0.030% S, 0.05 to 0.25% Mn with Mn/S ratio being 7 to 30.

4. A method according to claim 1, in which the steel strip obtained shows a $\bar{r}$ value not lower than 1.6.

5. A method according to claim 1, in which the over-aging temperature is in range from 450° to 550° C.

6. A method according to claim 1, the cooling from the recrystallization annealing temperature to the over-aging temperature or 200° C. is done with an average rate of 5° to 20° C./second.

7. A method according to claim 1, in which the steel sheet after the over-aging is successively temper rolled at a temperature not higher than 50° C.

* * * * *